United States Patent [19]

White

[11] Patent Number: 4,823,522

[45] Date of Patent: Apr. 25, 1989

[54] ENERGY ABSORBING AND ASSEMBLY FOR STRUCTURAL SYSTEM

[75] Inventor: William H. White, Concord, Calif.

[73] Assignee: Bechtel International Corporation, San Francisco, Calif.

[21] Appl. No.: 41,180

[22] Filed: Apr. 22, 1987

[51] Int. Cl.[4] ..... E04H 9/00

[52] U.S. Cl. ..... 52/167; 14/16.1; 248/596

[58] Field of Search ..... 52/167; 14/16.1; 248/629, 596, 598

[56] References Cited

U.S. PATENT DOCUMENTS

| | | | |
|---|---|---|---|
| 3,606,704 | 9/1971 | Denton | 52/167 |
| 4,230,291 | 10/1980 | Marshall | 248/629 |
| 4,605,106 | 8/1986 | Fyfe et al. | 52/167 |
| 4,620,688 | 11/1986 | Khlaffah et al. | 248/629 |

FOREIGN PATENT DOCUMENTS

| | | | |
|---|---|---|---|
| 846630 | 7/1981 | U.S.S.R. | 14/16.1 |
| 1158649 | 5/1985 | U.S.S.R. | 14/16.1 |

*Primary Examiner*—David A. Scherbel
*Assistant Examiner*—Caroline D. Dennison
*Attorney, Agent, or Firm*—Townsend and Townsend

[57] ABSTRACT

An energy absorbing assembly in which a number of spaced, metallic plate-like elements are coupled together by end blocks and spacers clamped together so that the elements are generally parallel with each other and are cantilevered from the upper ends thereof. In one embodiment, the upper ends of the elements are rigidly coupled to a floor beam and the cantilevered ends are coupled by a plate-like strut to an adjacent column to which the floor beam is pivotally mounted. A number of rollers permit free movement of the lower ends of the plates relative to the upper ends thereof. In a second embodiment, the assembly has elements which are bow tie-shaped plates, and the upper ends of the elements are rigidly secured to a horizontal floor beam. Diagonal braces are secured at opposed lower ends of the elements, and the lower ends of the braces extend downwardly and away from each other and are secured to the next floor beam therebelow.

11 Claims, 6 Drawing Sheets

FIG. 1
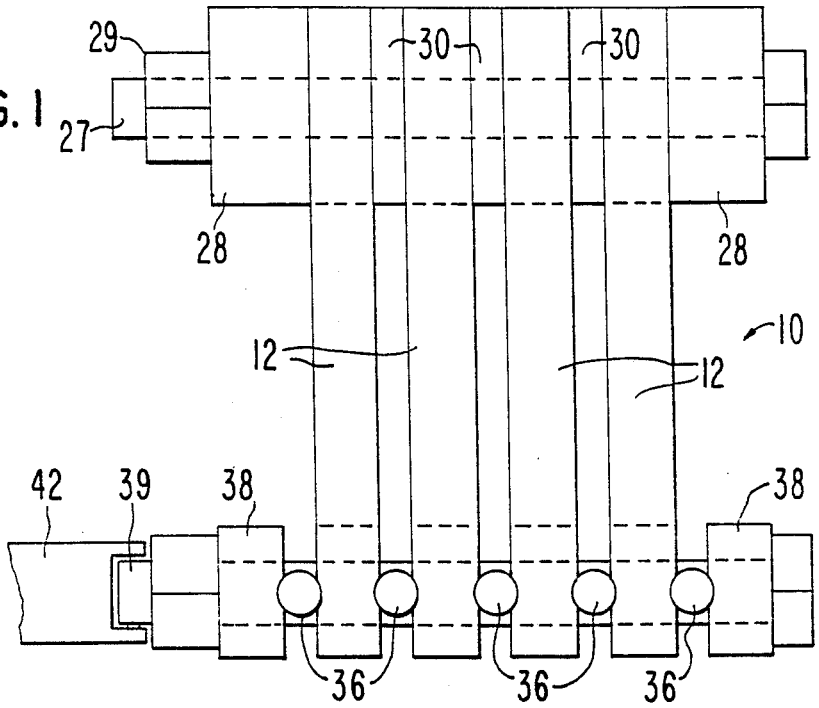
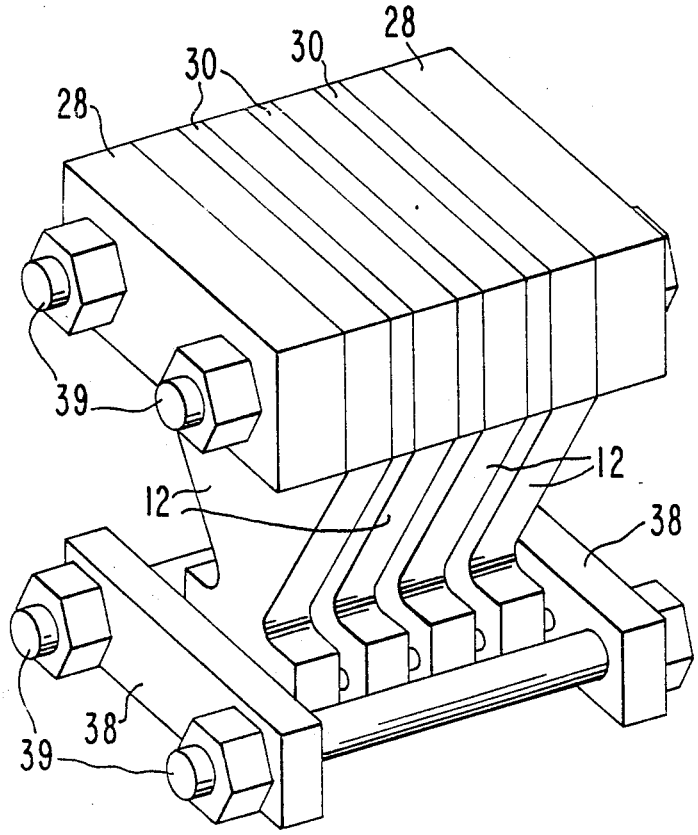
FIG. 1A

ENERGY ABSORBING AND ASSEMBLY FOR STRUCTURAL SYSTEM

BACKGROUND OF THE INVENTION

1. Field of the Invention

This invention relates to structural systems such as buildings and the like and, more specifically, to the absorption of energy caused by the application of seismic and other forces to a building to thereby minimize the structural damage to such building.

2. Description of the Prior Art

Buildings of different configurations are typically comprised of vertical columns and horizontal floor beams coupled to the columns. Generally, the ends of the floor beams butt up against adjacent columns and are welded to the columns to secure the structural system in place in a rigid manner. This arrangement is satisfactory to absorb the energy from mild or small seismic shocks or forces exerted on the structural system: however, when such seismic shocks or forces are relatively large in magnitude, the structural system comprised of the columns and beams may suffer irreparable damage such that the structural system must be dismantled and rebuilt.

To minimize such structural damage, damping devices of different types have been used between the columns and beams to absorb some of the energy. However, such damping devices have not been completely satisfactory for one or more reasons, and improvements in energy absorbing means for structural systems of the type described is needed to provide a more positive means for absorbing seismic and other forces, such as forces due to blasts.

An energy absorbing device adapted to be coupled to a piping system or the like has been disclosed in U.S. Pat. No. 4,620,688. In this disclosure, a number of plate-like energy absorbing members of a bow tie or X-shaped configuration is provided. First ends of the energy absorbing members are coupled to a fixed support, such as a wall, and second ends of the members are cantilevered from the first ends, and an arm is coupled rigidly to the cantilevered ends of the element. The arm projects outwardly and has an end secured to one end of an elongated connector. The opposite end of the connector is coupled to a piping system or the like, the attachment point between the outer end of the arm and the connector being in a plane passing through the central or smallest regions of the energy absorbing members to minimize tension and compression in the members during displacement of the arm and thereby the cantilevered ends of the members themselves. Thus, the members will be substantially free of structural damage to buckling to provide a long, useful operating life for the members.

While the arrangement of elements in the foregoing disclosure is satisfactory for a number of structural applications, including piping systems and the like, it still can be improved upon when energy associated with relative movements of columns and beams of a structural system are to be absorbed.

The present invention provides such improvements because it provides for smaller deflections in building applications than in piping applications.

SUMMARY OF THE INVENTION

The present invention provides an energy absorbing assembly in which a number of spaced metallic plate-like elements are coupled together by end blocks and spacers clamped together so that the elements are generally parallel with each other and are cantilevered from the upper ends thereof. In one embodiment of the invention, the upper ends of the elements are rigidly coupled to a floor beam and the cantilevered ends are coupled by a plate-like strut to an adjacent column to which the floor beam is pivotally mounted. In the first embodiment also, a number of balls are used to permit free movement of the lower ends of the plates relative to the upper ends thereof.

In a second embodiment of the invention, the assembly has elements which are bow tie-shaped plates, and the upper end of the elements are rigidly secured to a horizontal floor beam. Diagonal braces are secured at opposed lower ends of the elements, and the lower ends of the braces extend downwardly and away from each other and are secured to the next floor beam therebelow.

The assembly of the present invention is to be used to improve the response of a structural system, such as one found in buildings, to dynamic loads by increasing the ability of the system to absorb energy. This increase in energy absorption or damping is accomplished by the bending or straining of the plate-like elements of the assembly beyond their yield points. By increasing the damping capability, the structural system will shake less violently when subjected to dynamic loads such as those resulting from earthquakes or blasts. The unique triangular shape of the plate-like elements of the first embodiment is an essential part of the assembly because this configuration allows straining of the material to be essentially uniform over the full length and width of the plates.

The primary object of the present invention is to provide an energy absorbing assembly of plate-like elements which are arranged so that the assembly can be coupled to a structural system made up of columns and beams wherein the assembly will increase the damping capability of the structural system to thereby protect it from damage when subjected to dynamic loads, such as those resulting from earthquakes or blasts.

Other objects of this invention will become apparent as the following specification progresses, reference being had to the accompanying drawings for an illustration for several embodiments of the invention.

IN THE DRAWINGS

FIG. 1 is an elevational view of an energy absorbing assembly of the present invention, showing a number of generally horizontally spaced, vertical plate-like elements coupled together as a unit;

FIG. 1A is a perspective view of the assembly of FIG. 1;

Figure 4:
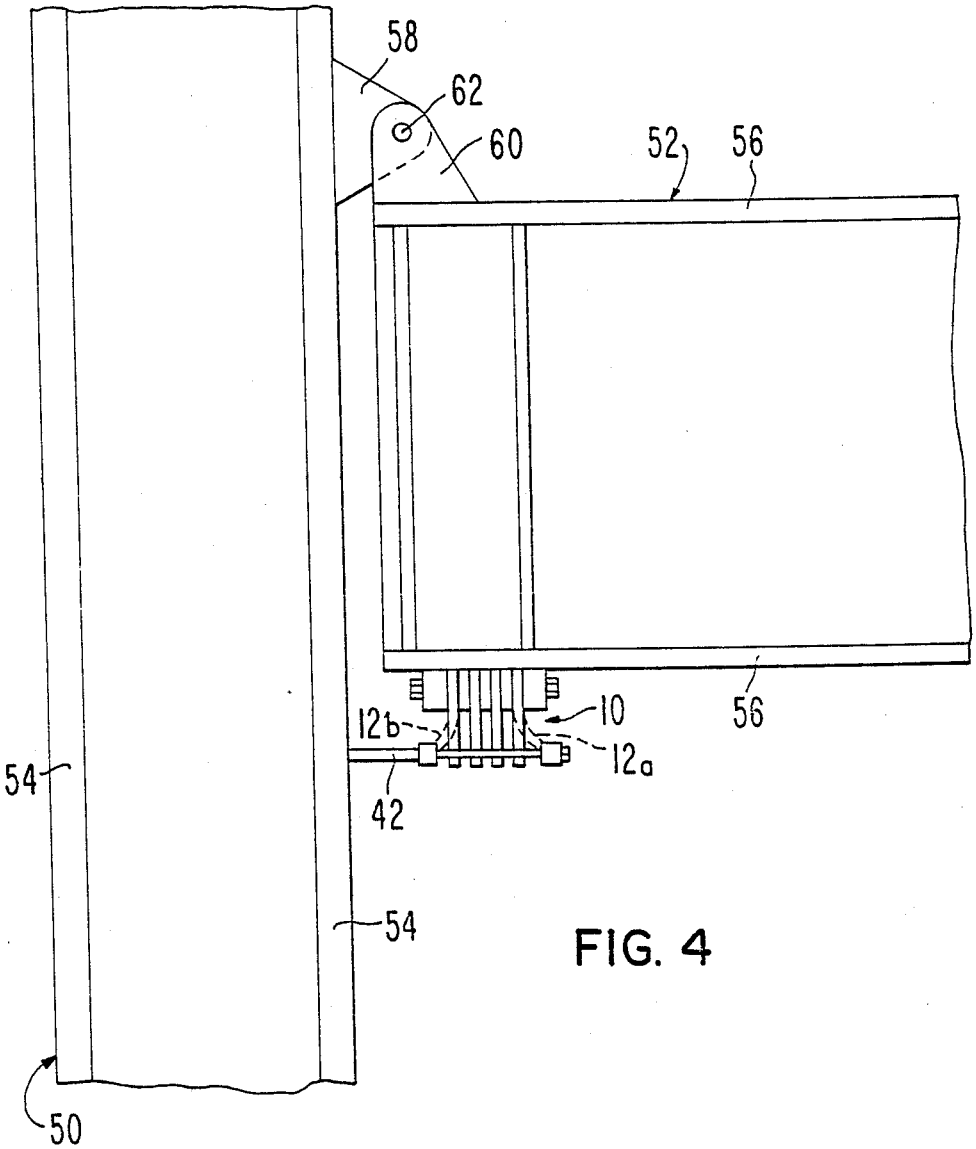
Figure 5:
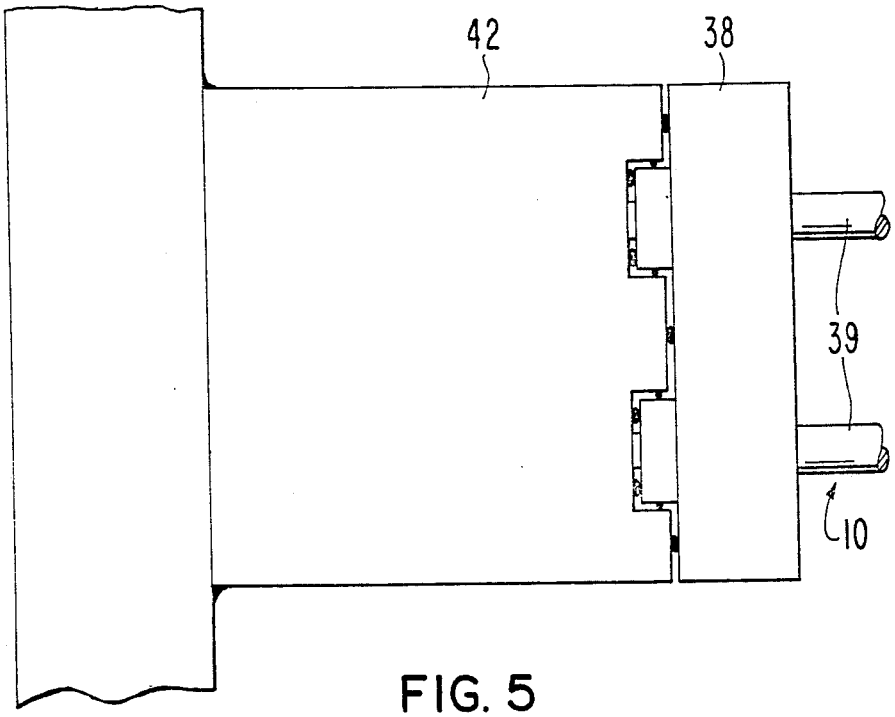
Figure 6:
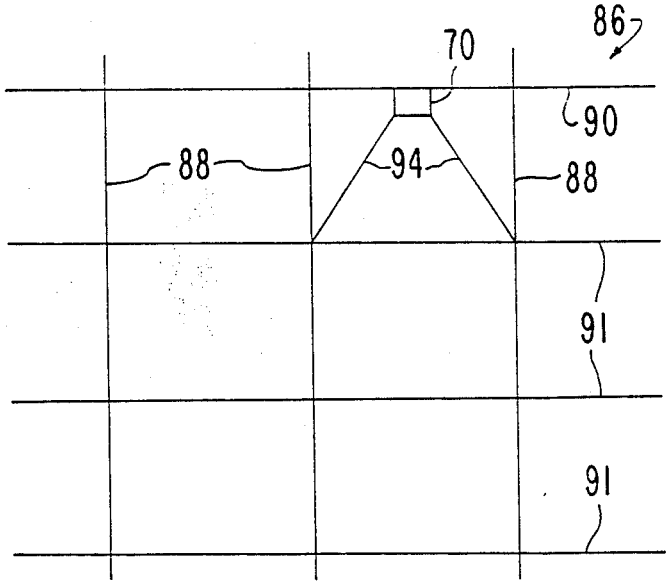
Figure 7:
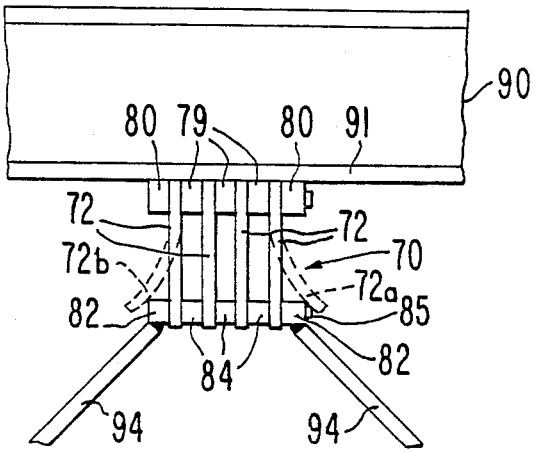
Figure 8:
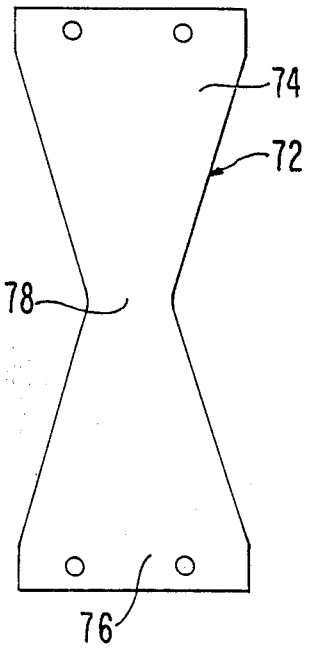
Figure 9:
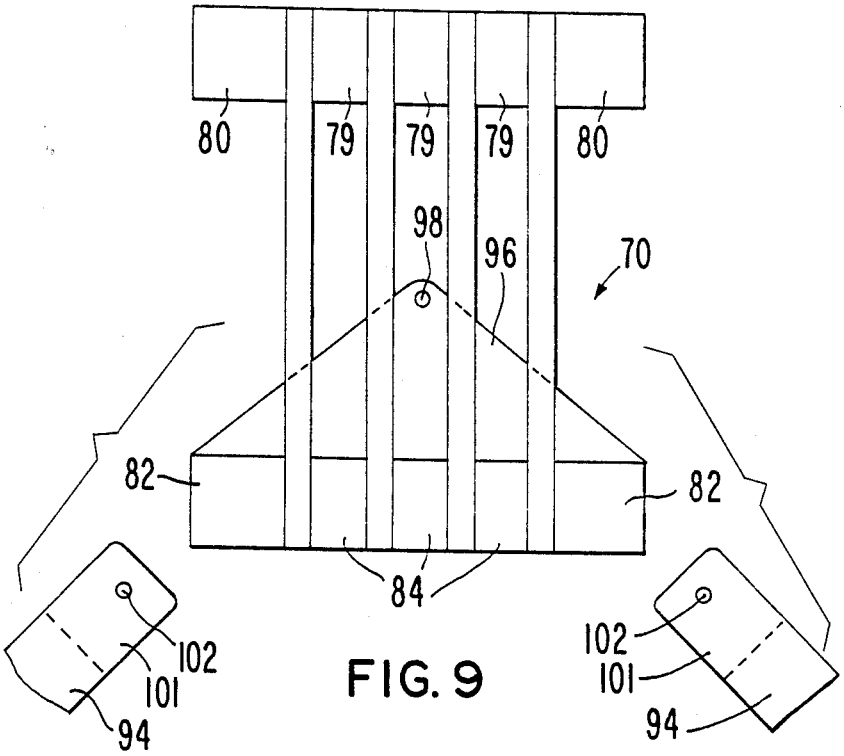
Figure 10:
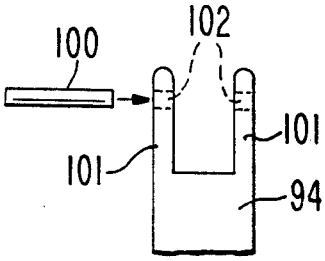

FIG. 4 a schematic view of a column and floor beam coupled together by the energy absorbing assembly of the present invention:

FIG. 5 is an enlarged, fragmentary schematic view of the assembly, showing a strut for connecting the assembly to a vertical column;

FIG. 6 is a schematic view of a group of columns and floor beams with one of the beams being provided with another embodiment of the energy absorbing assembly of invention;

FIG. 7 is an enlarged, fragmentary, schematic view of the assembly, of FIG. 6, showing the way in which it is coupled to upper and lower beams;

FIG. 8 is a side elevational view of one of the plate-like elements of the assembly of FIGS. 6 and 7;

FIG. 9 is an elevational view of the assembly of FIGS. 6 and 7, showing the diagonal braces therefor for coupling the assembly to a floor beam therebelow;

FIG. 10 is an elevational view of one end of one of the braces 9; and

Figure 11:
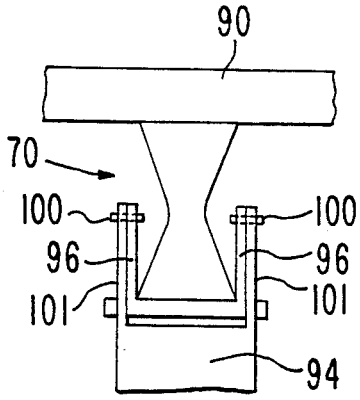

FIG. 11 is an elevational view of the assembly of FIGS. 6 7 and 9, showing the way in which the brace of FIG. 10 is coupled to the assembly of plates.

Figure 2:
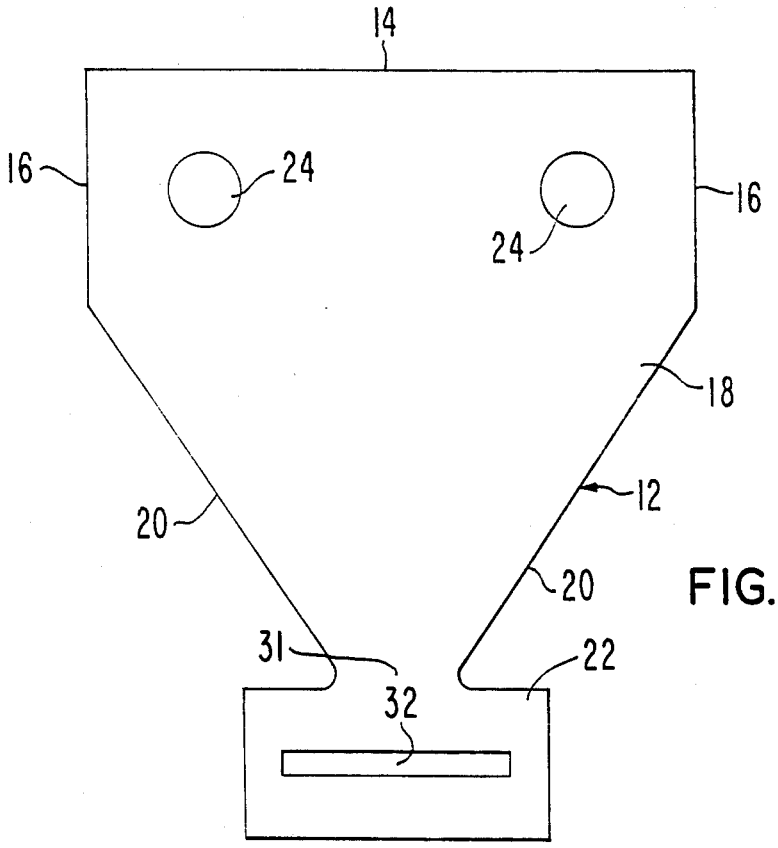
FIG. 2 is an elevational view of one of the plates of the assembly of FIG. 1.
Figure 3:
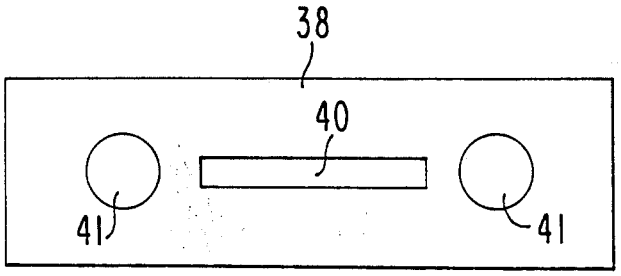
FIG. 3 is an elevational view of one of a pair of lower end blocks forming part of the assembly of FIG. 1.

A first embodiment of the energy absorbing assembly of the present invention is broadly denoted by the numeral 10 and includes a plurality of spaced plate-like energy absorbing elements 12, each element being of the type shown in FIG. 2. The elements are arranged in vertical positions, generally parallel with each other as shown in FIG. 1. Each element 12 has an upper rectangular part 14, a central triangular part 18 having a pair of inclined edges 20 which converge toward each other as a lower part 22 is approached. The lower part is generally rectangular in shape but of smaller size than the upper part 14. Parts 14. 18 and 22 are integral with each other, and the elements 12 are formed from a suitable heavy duty material, such as steel.

The upper part 14 of each element 12 has a pair of spaced holes 26. A pair of end blocks 28 and several spacers 30 shown in FIG. 1 clamp parts 14 together when a pair of bolts pass through the parts 14, spacers 30 and blocks 28. Nuts 29 secure the bolts in place. Elements 12 project outwardly and downwardly in cantilever fashion from the spacers and the end blocks.

Each element 12 has a region 31 of minimum dimension at the junction between parts 18 and 22 as shown in FIG. 2. Thus, part 18 is essentially triangular in configuration and any bending of the element due to absorption of energy thereby will typically occur at region 31.

The opposed faces of each lower part 22 of each element 12 includes a rectangular recess 32 which extends generally parallel to the lower edge 34 of lower part 22. These recesses are adapted to partially receive cylindrical rollers 36 in the manner shown in FIG. 1 and the rollers are in rolling relationship to the elements to provide a means for allowing for free rotation of the lower ends of elements 12 when assembly 10 is in use in the manner described with respect to FIG. 4.

A pair of end blocks 38 are provided at the lower end of assembly 10. Each end block 38 has one face provided with a recess 40 of the same size as and in horizontal alignment with the recesses 32 of parts 22 of elements 12 as shown in FIG. 1. A pair of bolts 39 pass through holes 41 in end blocks 38 and nuts 43 are threaded on the bolts. Thus, the bolts couple the lower ends of elements 12 together with the elements 12 being clamped together by end blocks 38 and with rollers 36 in place in recesses 32 and 40, respectively.

A plate-like strut 42 is rigidly secured to and extends laterally from one of the end blocks 38 as shown in FIGS. 1 and 5. The strut has an edge which is welded to the exposed portions at the sides of the adjacent end block 38. Recessed portions 46 are formed in the adjacent end of strut 42 to provide clearance for the nuts 37 on bolts 39.

In use, assembly 10 is coupled between a vertical column 50 and a horizontal floor beam 52 as shown in FIG. 4. Column 50 and beam 52 typically are parts of a structural system, such as a building, and both the column and the beam are typically of I-beam or wide flange beam construction with column 50 having side flanges 54 and beam 52 having top and bottom flanges 56. Ears 58 and 60 are provided on column 50 and beam 52, respectively, and these are coupled together by a pin 62 so that beam 52 will be spaced laterally from column 50 and can pivot about pin 62 relative to column 50 in the event of an earthquake.

Assembly 10 is coupled to the lower flange 56 of beam 52 by welding the upper end blocks 28 of assembly 10 to the bottom surface of the lower flange 56 of beam 52. Strut 42 will have been welded to the lower end of the block in the manner shown in FIG. 5, and the outer end of strut 42 will be welded to the adjacent flange 54 of column 50 in the manner shown in FIG. 4. Thus, assembly 10 is rigidly secured to both column 50 and beam 52. In lieu of welding the assembly 10 to column 50 and beam 52, bolts or other fasteners can be used, if desired, to provide a rigid connection between assembly 10 and the column and the beam.

If the building containing column 50 and beam 52 is subjected earthquake or blast loads, elements 12 of assembly 10 operate to absorb much of the energy associated with the deflection of beam 52 relative to column 50. For instance, if the column deflects to the left, the space between the lower flange 56 and the column will decrease and elements 12 to assume the dash line positions of element **12*a* in FIG. 4 in which the elements 12 will exceed the elastic limit and suffer a permanent set, assembly 10 can be replaced, if deemed desirable or necessary,such as when the elements 12 are sufficiently bent out of shape so as to be essentially useless to absorb any future earthquake shocks or blast loads. In the event that an earthquake tremor causes beam 52 to rotate in a clockwise sense when viewing FIG. 4, the energy absorbed by elements 12 of assembly 10 will cause the elements to assume a dash line position 12*b* (FIG. 4). Even if elements 12** undergo a permanent set, they still may be useful in further absorbing seismic shock or blast loads. Thus, there may be no need to replace the assembly even after a permanent set has occurred.

Assembly 10 is used to improve the response of the structural system, having column 50 and beam 52, to dynamic loads by increasing the ability of the structural system to absorb energy. This increase in energy absorption or damping is achieved by bending or straining elements 12 of assembly 10 beyond their yield point. By increasing the damping due to the presence of assembly 10, column 50 and beam 52 will shake less violently when subjected to dynamic loads, such as those resulting from earthquake or blast loads. The unique shape of elements 12 is an essential part of the assembly 10 because this shape allows a straining of the material to be essentially uniform over the full length and width of each element 12.

Another embodiment of the energy absorbing assembly of the present invention is broadly denoted by the numeral 70 and is shown in FIGS. 6–11. Assembly 70 is comprised of a group of generally parallel plate-like elements 72 having the bow tie configuration of FIG. 8 wherein the plate element 72 has an upper triangular part 74 and a lower triangular part 76 with a region 78 of reduced transverse dimension therebetween. The assembly 70 has a number of upper spacers 79, a pair of upper end blocks 80 and bolts 81 at the upper end of the assembly. Similarly, end blocks 82, spacers 84 and bolts 85 are provided on the lower part of assembly 70.

Assembly 70 is adapted to be used with a structural system 86 (FIG. 6) in which vertical steel columns 88 are coupled with generally horizontal floor beams 90 in any suitable manner. Typically, assembly 70 is secured to the central part of and below a beam 90 as shown in FIG. 6 and 7. End blocks 80 of assembly 70 are welded to the flange 91 the beams 90 and 91 with elements 72 extending downwardly from the beam 90 as shown in FIG. 7. Inclined braces 94 are secured by welding to the end blocks 82 of assembly 70, and the braces extend downwardly and away from each other and terminate at junctions between the floor beam 91 therebelow and the adjacent columns 88 as shown in FIG. 6.

In use, assuming assembly 70 is coupled to a beam 90 as shown in FIGS. 6 and 7, whenever a seismic load or shock is exerted on the structural system 86, beam 90 will move to the right or to the left relative to beam 91. In so moving, the elements 72 of assembly 70 will be deflected beyond their elastic limit and so will suffer a permanent set. If braces 94 move to the right when viewing FIG. 7, elements 72 will assume the dash line positions 72*a* as shown in FIG. 7. If the braces move in the opposite direction, the elements 72 will move in the direction of dash lines 72*b*.

Another way of coupling the upper ends of braces 94 to assembly 70 is to provide a pair of triangular plates 96 (FIGS. 9 and 11) on the end blocks at the bottom of assembly 70 as shown in FIG. 9. Each plate 96 will have a hole 98 for receiving a pin 100 which also pivotally mounts the upper end of a brace, each brace having a pair of spaced end parts 101 provided with holes 102 therethrough. FIG. 11 shows the way in which the upper ends of a brace 94 is coupled to plates 96 by pins 100 passing through holes 01 in the brace and holes 98 in plates 96. Pins 100 will be at a location in the planes of regions 78 of elements 72.

I claim:

1. In a structural system:

a vertical column; a horizontal floor beam; means at one end of the floor beam near the upper part thereof for pivotally mounting the floor beam on the column; and an energy absorbing assembly coupled to the column and to the floor beam near the lower part of the floor beam and adjacent to said one end thereof, the assembly including a plurality of horizontally spaced, vertically extending, plate-like elements, the upper ends of the elements being coupled with the lower part of the floor beam and strut means coupling the lower ends of the elements to the column, said lower ends of the elements being movable as a function of the movement of the floor beam relative to said column.

2. In a system as set forth in claim 1, wherein each element is generally triangular in shape.

3. In a system as set forth in claim 1, wherein each pair of adjacent lower ends of the adjacent elements has a roller therebetween.

4. In a system as set forth in claim 3, wherein each element has a recess for partially receiving an adjacent roller.

5. In a system as set forth in claim 3, wherein is included a pair of end blocks adjacent to the lower ends of the elements, and bolt means coupled to the end blocks, there being a strut connecting one of the end blocks to the column.

6. In a system as set forth in claim 1, wherein is included clamping means near the upper ends of the elements for clamping the elements together. said clamping means being rigidly connected to the floor beam.

7. In a structural system comprised of a number of horizontally spaced, vertical columns and a number of vertically spaced, horizontal floor beams, an energy absorbing assembly comprising:

a plurality of generally vertical, parallel energy absorbing, plate-like elements, each element having a region of reduced transverse dimension; means clamping the upper ends of the elements together, said upper ends of the elements of the assembly adapted to be secured to a floor beam; means coupled with the lower ends of the elements to allow the elements to bend at said regions thereof; and bracing means coupled with the lower ends of the elements for coupling said lower ends to a floor beam therebelow.

8. In a structural system as set forth in claims 7, wherein each of the elements is in the shape of a bow tie.

9. In a structural system as set forth in claim 7, wherein said coupling means includes a pair of diagonal braces which converge toward each other as the lower ends of the elements are approached, the lower ends of the braces adapted to be coupled to the floor beam therebelow.

10. In a system as set forth in claim 9, wherein the upper ends of the braces are coupled to the lower ends of the elements.

11. In a system as set forth in claim 9, wherein is included a pair of side plates, each plate having a triangular shape and provided with an upper part aligned with the central part of the element, said braces being coupled to the upper part by a pivot pin.

* * * * *